US005715969A

United States Patent [19]

Seerup et al.

[11] Patent Number: 5,715,969

[45] Date of Patent: Feb. 10, 1998

[54] CONTAINER FOR HEALTH CARE PRODUCT

[75] Inventors: Søren Seerup, Taastrup; John Seeberg, Holte, both of Denmark

[73] Assignee: Ferrosan A/S, Denmark

[21] Appl. No.: 530,229

[22] PCT Filed: Mar. 23, 1994

[86] PCT No.: PCT/DK94/00120

§ 371 Date: Nov. 13, 1995

§ 102(e) Date: Nov. 13, 1995

[87] PCT Pub. No.: WO94/21212

PCT Pub. Date: Sep. 29, 1994

[30] Foreign Application Priority Data

Mar. 23, 1993 [DK] Denmark ..... 0329/93

[51] Int. Cl.[6] ..... B65D 1/04; B65D 25/04

[52] U.S. Cl. ..... 220/503; 215/6; 220/524; 220/526

[58] Field of Search ..... 220/524, 555, 220/520, 553, 423, 526, 523, 500, 503, 254; 215/6

[56] References Cited

U.S. PATENT DOCUMENTS

| | | | |
|---|---|---|---|
| 292,502 | 1/1884 | Moran | 220/503 X |
| 1,661,728 | 3/1928 | La Rue | 220/523 |
| 1,827,929 | 10/1931 | Bigelow | 220/523 |
| 1,938,519 | 12/1933 | Deffenbaugh | 220/503 |
| 2,110,411 | 3/1938 | White | 220/503 |
| 2,939,575 | 6/1960 | Tarara | 220/500 X |
| 3,061,136 | 10/1962 | Sterngart | 220/520 X |
| 3,732,999 | 5/1973 | Rounkles | 220/503 X |
| 5,158,209 | 10/1992 | Reil et al. | 220/4.23 X |

FOREIGN PATENT DOCUMENTS

| | | | |
|---|---|---|---|
| 0 077 189 A1 | 10/1982 | European Pat. Off. . | |
| 0 474 419 A1 | 8/1991 | European Pat. Off. . | |
| 3744438 A1 | 12/1987 | Germany . | |
| 0009018 | 7/1886 | United Kingdom | 220/524 |

*Primary Examiner*—Allan N. Shoap
*Assistant Examiner*—Niki M. Kopsidas
*Attorney, Agent, or Firm*—Finnegan, Henderson, Farabow, Garrett & Dunner, L.L.P.

[57] ABSTRACT

A health care product container having a generally rectangular cross section and closed at one end by a bottom wall molded integrally with the container vessel. The other end is provided with a filling opening which corresponds to the cross section of the container, and which is closed by a closing part. The container has an internal partition integral with the container vessel, parallel with one of its side walls, and dividing the container into first and second compartments. Each compartment is closed at one end by said bottom wall and being open at its other end. The closing part is so designed that it sealingly closes the first compartment at its one end, but leaves access to the second compartment, the sealed compartment being a product containing compartment provided with a dispensing opening closable by a stopper. The second compartment is closed by a lid hinged to the closure part or to the vessel.

2 Claims, 5 Drawing Sheets

CONTAINER FOR HEALTH CARE PRODUCT

CROSS-REFERENCE TO RELATED APPLICATIONS

Figure 1:
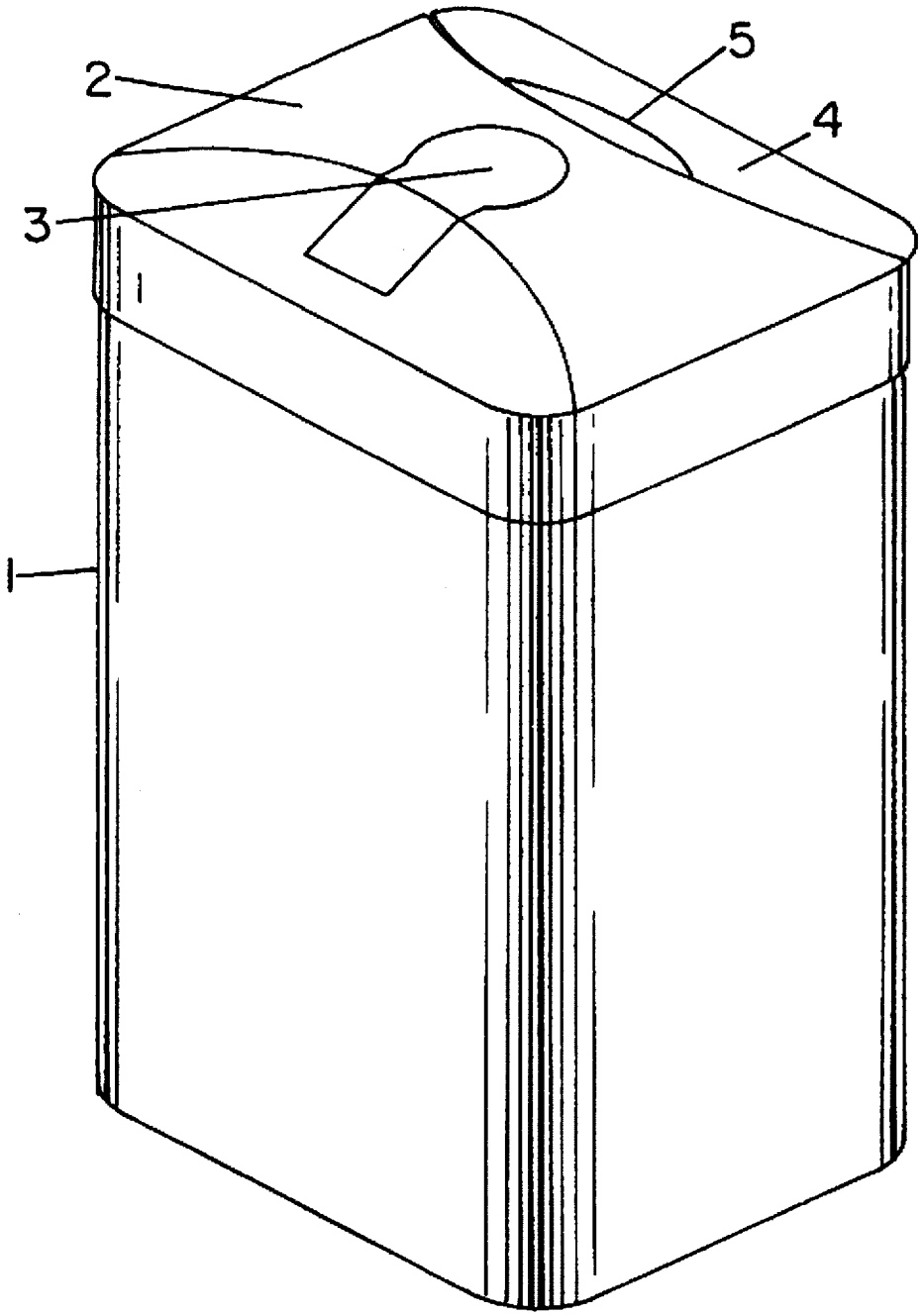

This application is a continuation of PCT/DK94/00120 filed Mar. 23, 1994, which is incorporated herein by reference.

The invention relates to containers for health care products, which containers comprise a container vessel having a mainly rectangular cross section and being at one end closed by a wall molded integrally with the container, which is at its other end provided with a filling opening which corresponds to the cross section of the container and which can be closed by a closing part.

Such containers may be used for pills, tablets, or a powdery or granular product. Often the product should be accompanied by a description of the product and examples of its use or other kinds of information exceeding what may be written on the label. This problem has been overcome by further packing the container in a cardboard box also accommodating a pamphlet or a folder with the necessary information. Alternatively, the pamphlet or folder may be packed in a separate container attached to the container for the product.

However, the above mentioned solutions are unsatisfactory for various reasons. The use of a further cardboard box is contrary to the existing wish of reducing the use of packaging material. Further, if the container is removed from the cardboard box and this box is disposed of, another place for storing the pamphlet must be found. Where the pamphlet is stored in a separate container, this container may remain coupled to the product container, but still the risk exists that the instruction may not be found in close relation to the product.

It is the object of the invention to provide an integral container for a product as well as a pamphlet or a folder.

This is obtained by a container as the one described in the opening of this specification, and which according to the invention is characterized in, that the container has an internal partition which is integral with the container and parallel with one of its side walls, and which divides the container into a first and second compartment, each compartment being at its one end closed by said wall and being open at its other end, and that the closing part is so designed that it sealingly closes the first compartment at its open end, but leaves access to the second compartment, the sealed compartment being a product containing compartment which is provided with a dispensing opening.

U.S. Pat. No. 4,838,424 discloses a container for various chemicals such as fungicides, wherein a brochure is made separately accessible from the outside of the container and is stored in this container in a compartment separated from the compartment containing the chemical. The compartment for the chemical is formed by a bag shaped liner inserted in a cardboard box, and the container for the brochure is provided between the liner and a side wall of the cardboard box. The brochure is glued to its compartment to keep it in position therein, and once it is removed from this compartment it is difficult to put it back again, as the product will press the liner against the cardboard wall. The container is obviously designed for a product which is used at once or during a short time when the lining compartment is opened, and it will not be suited for health care products which are dispensed in small doses during a long period, during which period it should be possible to take out the information brochure and put it back again, as long as product is left in the product compartment.

According to the invention the partition is preferably parallel with the long side wall of the container, so that the need for folding the pamphlet to store it in the compartment is minimized. Further, the compartment accommodating the pamphlet may be narrow, so that the compartment accommodating the product occupies most of the space in the container.

The second compartment accommodating the pamphlet is closed by a lid part which may be opened to give access to this accessible second compartment without influencing the closure of the product compartment.

According to the invention, the lid part may either be hinged to a closing part of the product compartment, or it may be hinged to the bottom of the second compartment wherein the hinge extends parallel to an edge of the partition. The lid part may comprise the long side wall of the second compartment, and short side walls extending from the second compartment long side wall and being folded to form lips engaging ribs along the junction between the partition and the side walls of the first compartment.

Figure 2:
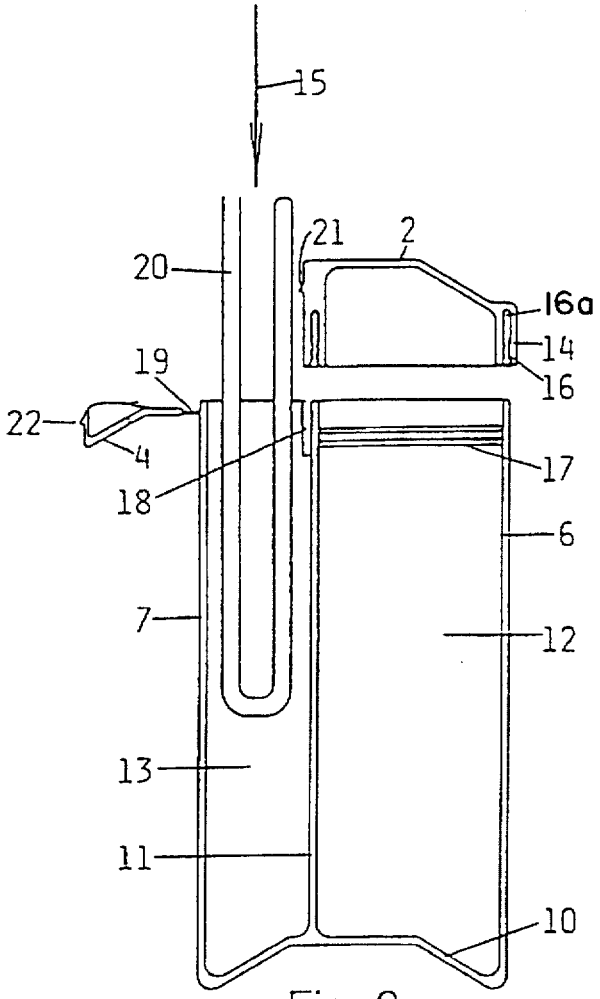
Figure 3:
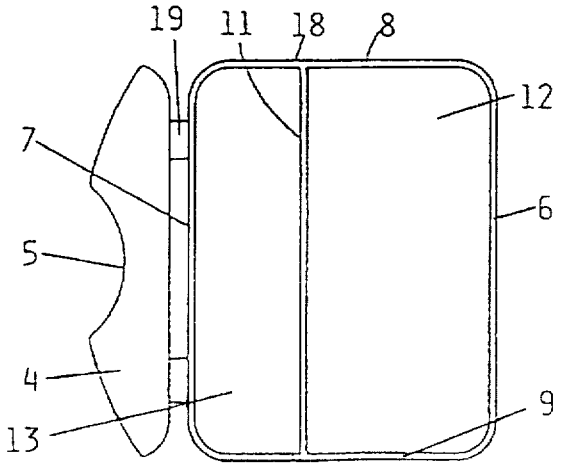
Figure 4:
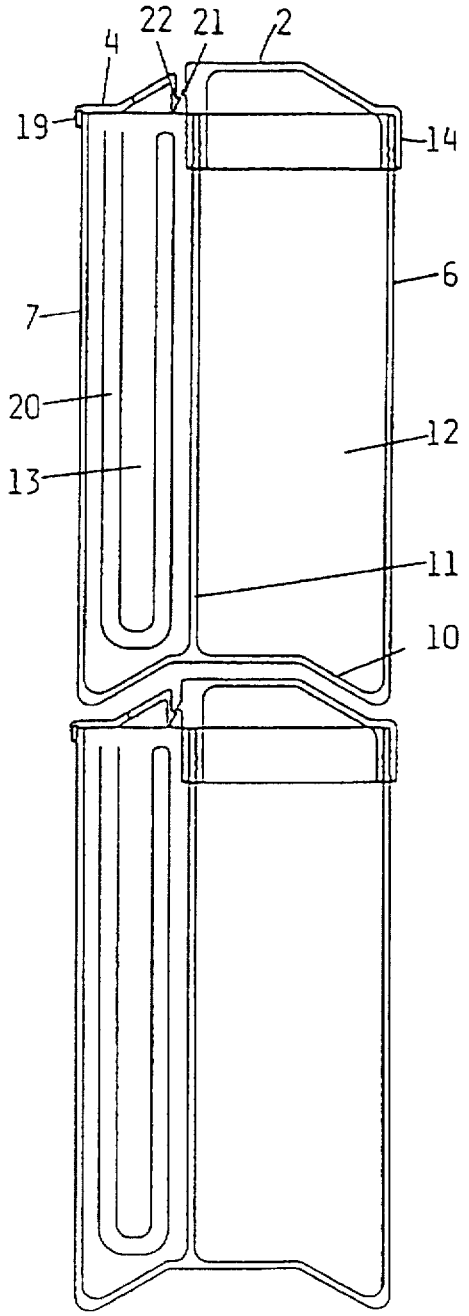
Figure 5:
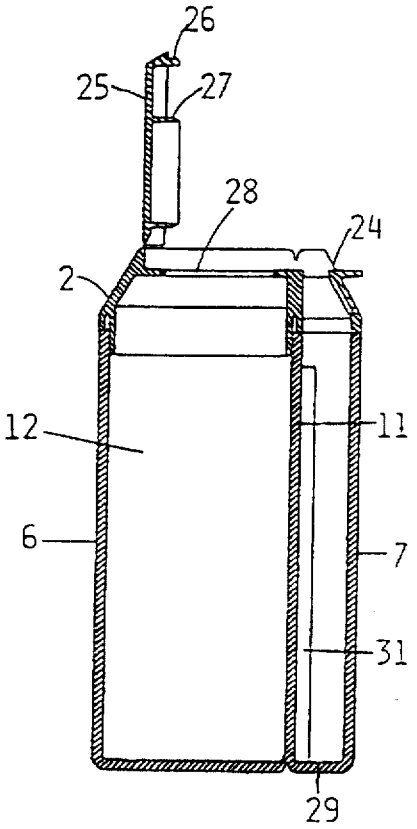
Figure 7:
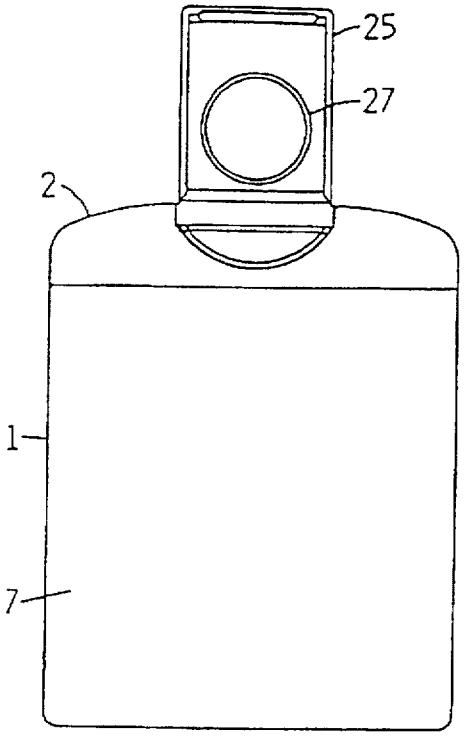
Figure 6:
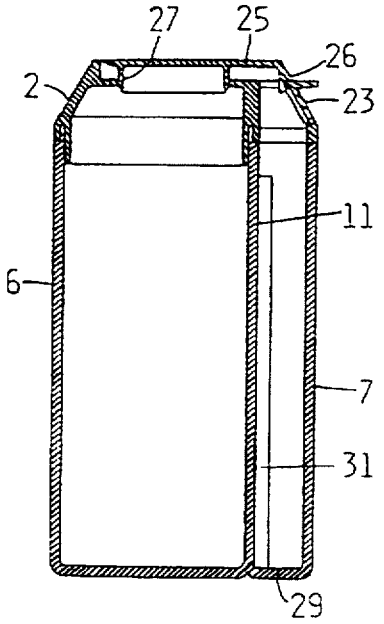
Figure 8:
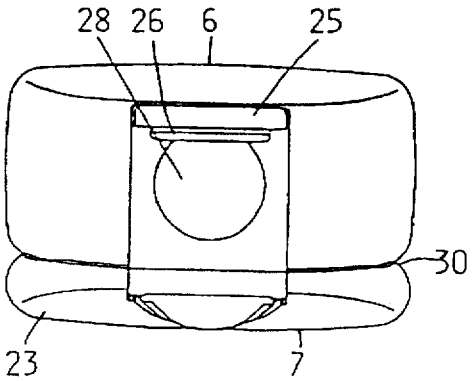
Figure 9:
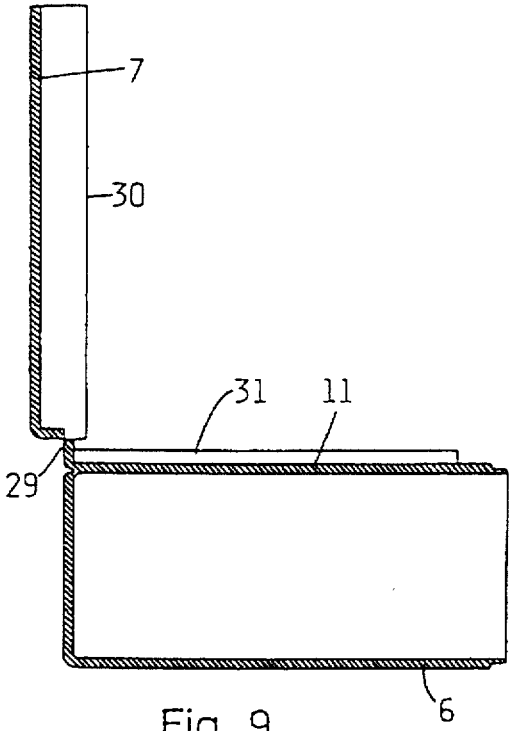

In the following, the invention will be further specified with references to the drawings, wherein FIG. 1 shows a perspective view of a container according to the invention, FIG. 2 shows a sectional side view of the container of FIG. 1 with the closing part unmounted, the lid open, and a pamphlet partly inserted, FIG. 3 shows a plan view of the container vessel of the container of FIGS. 1 and 2, FIG. 4 shows a sectional side view of two of the containers in FIG. 1 piled one on the other, and FIG. 5 shows a sectional view of another embodiment of a container according to the invention, open for dispensing, FIG. 6 shows the container of FIG. 5 closed, FIG. 7 shows a side view of the dispenser of FIG. 5, FIG. 8 shows the container of FIG. 7 seen from the top, FIG. 9 shows the container vessel of the container according to FIGS. 5 to 8 as it appears immediately after its molding.

Figure 10:
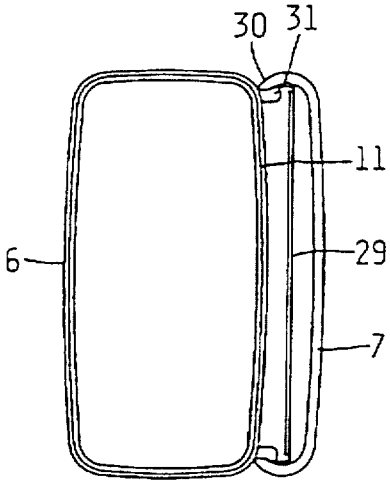
Figure 11:
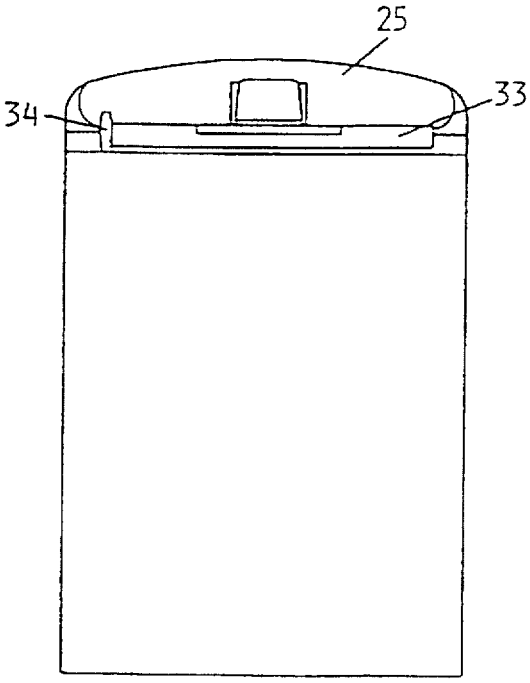
Figure 12:
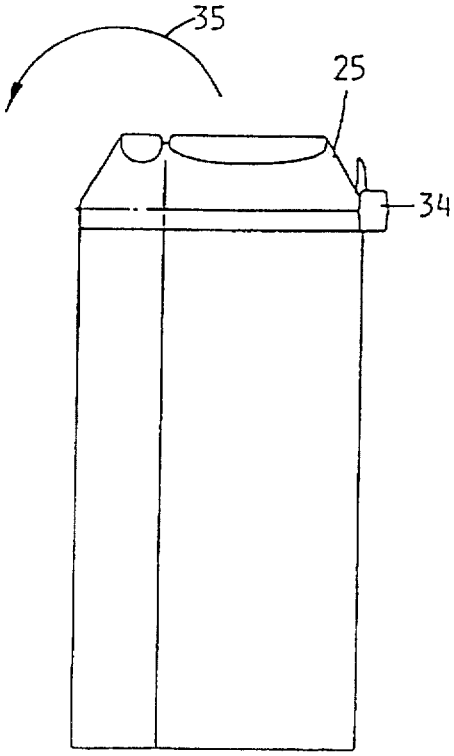
Figure 13:
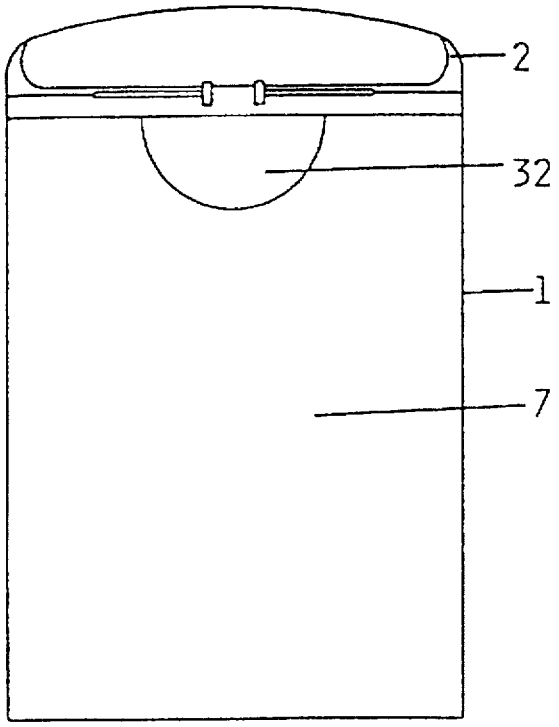
Figure 14:
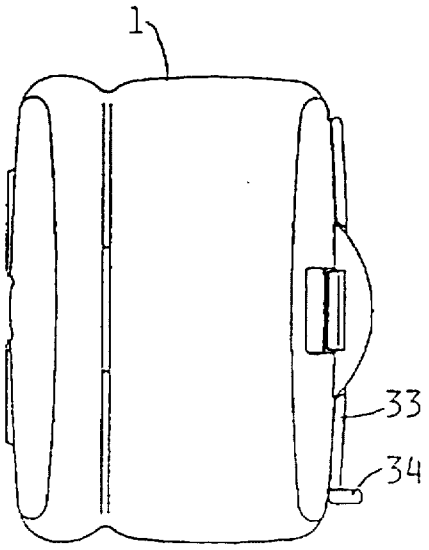
Figure 15:
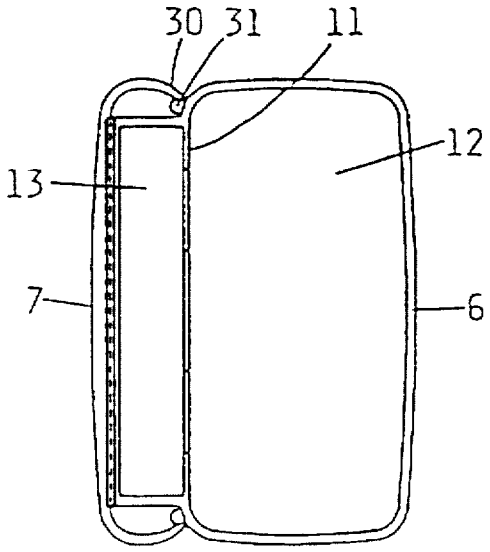

FIG. 10 shows the vessel of FIG. 9 with its lid closed,

FIG. 11 shows an elevation of another embodiment of the container according to the invention, seen from the dispensing side, FIG. 12 shows a side view of the container of FIG. 11, FIG. 13 shows an elevation of the container of FIG. 11 seen from the pamphlet holding side, FIGS. 14 shows the container according to FIG. 11 to 13 seen from the top, and FIG. 15 shows the vessel of the container according to FIG. 11 to 14 seen from the top.

The container shown in FIG. 1 comprises a container vessel 1 and a closing part 2 closing a product compartment and being provided with a dispensing device suggested by the reference 3 in this Figure, but not shown in any of the following Figures. Further, the container comprises a lid 4 barring the access to another compartment in the vessel 1 and being provided with a cutout 5 enabling the insertion of a finger for opening the lid to provide access to the underlying compartment.

In FIG. 2 showing a sectional side view of the container with the closing part 2 unmounted and from FIG. 3 showing the container vessel seen from above, it may be seen that the container vessel has a rectangular cross section with two long side walls 6 and 7, two short side walls 8 and 9, and a bottom 10 closing one end of the vessel. Further, the container vessel is provided with an internal partition 11 parallel with the long side walls 6 and 7 and dividing the inner space of the vessel into two compartments 12, and 13. The compartment 12 forming the compartment for the product, is closed by the closing part 2, this part having a circumferential depending wall 14 which is in its end surface provided with a recess accommodating the edge of the open end of the product compartment 12, i.e. the edges of the long side wall 6, of the part of the short side walls 8 and 9 lying between the long side wall 12 and the partition 11, and of the partition 11. Near the said edges circumferential snap lock means 17 are provided, which means cooperate with corresponding snap lock means 16 provided in the recess 16*a* in the depending wall 14 of the closing part 2 to secure this part sealingly to the container vessel. In the short side walls 8 and 9, recesses 18 are provided in the part of these walls forming the side walls of the compartment 13, the recesses being provided adjacent to the open end of this compartment and to the partition 11. When the closing part is mounted to close the product compartment 12, the recesses 18 accommodate the part of the depending wall 14 lying on the outer side of the recess 16*a*.

The accessible compartment 13 accommodates a paper 20 or pamphlet carrying information. This paper 20 may at any time be inserted into the compartment 13, as illustrated by the arrow 15, or it may be taken out to be studied. The lid 4 is hinged to the container vessel by a plastic hinge 19 molded integrally with the vessel, and the lid 4 is provided with projections 22 cooperating with corresponding projections 21 on the closing part 2 to maintain the lid 4 closed to prevent access to the pamphlet until it is opened to make the pamphlet accessible.

In FIG. 4 it is seen how the product compartment 12 is sealed by the mounting of the closing part 2, and the pamphlet 20 is lodged in the compartment 13 with the lid 4 closed to prevent the pamphlet from dropping out of its compartment when the container is handled. Further, it is shown how the wall 10 forming the bottom of the container may be shaped to mate the top formed by the closed lid 4 and the closing part 2, so that more containers of the kind described may be stacked.

In the following further embodiments of the container are described and corresponding parts are allocated corresponding reference numerals.

The container in FIG. 5 has a vessel closed by a closing part 2. The edges of the long side wall 6, of the part of the short side walls 8 and 9 lying between the long side wall and the partition 11, and of the partition 11 are glued, welded or in any other way secured sealingly to the closing part 2 to close the product compartment 12. A cantilever part 23 of the closure part 2 has a locking edge 24 which may be engaged by a locking hook 26 on a lid part 25 hinged to the closure part 2. The lid part 25 carries a stopper 27 which may close the product compartment 12 by fitting into an opening 28 in the closure part 2.

The bottom in the compartment 13 has a hinge 29 parallel with the partition. The short side walls of the compartment 13 are integral with the long side wall of this compartment, but not with short side walls of the compartment 12. The short side walls of the compartment 13 are joined to the short side walls of the compartment 12 by lips 30 along their edges engaging ribs 31 along the junction between the partition 11 and the short side walls of the compartment 12 on the outer side of this compartment. This construction makes it possible to open the pamphlet containing compartment 13 by disengaging the lips 30 from the ribs 31 and swinging the long side wall 7 away about the hinge 29.

FIG. 9 shows the container vessel as it leaves the mold. The hinged part comprising the long side wall 7 of the compartment 13 and the short side walls of this compartment, which short side walls are along its edges provided with lips 30, may be rotated about the hinge 29 to make the lips 30 engage ribs 31 at the outer side of the compartment 12 along the junction between the short side walls of this compartment and the partition 11 to form the compartment 13. FIG. 10 shows the container vessel seen from its open top before the closing part 2 is mounted.

The hinged part may be swung away to make the content of compartment 13 accessible. In the embodiment shown in FIG. 13 the wall 7 of the hinged part is provided with a cut out 32 into which a finger may be inserted to pull outwards the hinged part.

FIGS. 11 and 12 shows elevations of another embodiment of the container seen from its front side and from its left side. A sealing strip 33 is secured to the lid part 25 and to the vessel so that the lid part cannot be opened as indicated by the arrow 35 to give access to the content in the product compartment unless this sealing strip 33 is torn off. The sealing strip 33 is provided with a grip 34 which may be grasped by two fingers to tear off the sealing strip.

FIG. 14 shows a top view of the above mentioned embodiment with the closing part mounted, whereas FIG. 15 shows a top view of the vessel part. From this figure it is seen that in this embodiment the short side walls of the hinged part carry lips 30, but do not form the side walls of the compartment 13. The short side wall of this compartment are integral with the short side walls of the compartment 12 but moved a distance inward on the partition to make room for the pair of ribs 31 along the junctions between the short side walls and the partition 11. The side walls carrying the lips 30 may pass outwardly of the short side walls of the compartment 13 to engage the ribs 31 to close this compartment.

We claim:

1. A compartmented container having a generally rectangular cross section, defined by a first long side wall, a second long side wall, two short side walls and a bottom, and being divided into a first compartment, bound by said first long side wall, and a second compartment, bound by said second long side wall, said first and second compartments being divided by a partition substantially parallel with said first and second long side walls, the first compartment being sealingly closed by a top closing part, wherein said closing part is formed with a cantilever part which extends over said second compartment to engage said second long side wall, and wherein the second compartment includes a lid comprising said second long side wall, said lid also comprising three short wall portions extending from end portions of said second long side wall, two of said three short wall portions providing lips that engage ribs along corresponding end portions of the partition when the lid is closed, the third of the three short wall portions including a hinge for the lid and being connected to the container adjacent an edge of the partition.

2. A two compartment container according to claim 1, wherein the closure part comprises a second lid part hinged to the closure part to provide access to the first compartment.

* * * * *